US007245839B2

(12) United States Patent
Nakashima

(10) Patent No.: US 7,245,839 B2
(45) Date of Patent: Jul. 17, 2007

(54) PRINTER

(75) Inventor: Teruyoshi Nakashima, Saitama (JP)

(73) Assignee: Fujifilm Corporation, Tokyo (JP)

( * ) Notice: Subject to any disclaimer, the term of this patent is extended or adjusted under 35 U.S.C. 154(b) by 276 days.

(21) Appl. No.: 11/029,511

(22) Filed: Jan. 6, 2005

(65) Prior Publication Data

US 2005/0147421 A1 Jul. 7, 2005

(30) Foreign Application Priority Data

Jan. 7, 2004 (JP) ..... 2004-002397

(51) Int. Cl.
*G03G 15/00* (2006.01)

(52) U.S. Cl. ..... 399/24; 399/9

(58) Field of Classification Search ..... 399/8, 399/24–28; *G03G 15/00*
See application file for complete search history.

(56) References Cited

U.S. PATENT DOCUMENTS 5,282,127 A * 1/1994 Mii ..... 700/1
6,366,744 B1 * 4/2002 Phillips et al. ..... 399/24
6,493,517 B1 * 12/2002 Hanson ..... 399/11

FOREIGN PATENT DOCUMENTS

JP 2000-267520 A 9/2000

* cited by examiner

*Primary Examiner*—Daniel J. Colilla
*Assistant Examiner*—N. Ha
(74) *Attorney, Agent, or Firm*—Sughrue Mion, PLLC

(57) ABSTRACT

A printer detects a roll radius of a recording paper roll once a day and measures the remaining amount of recording paper. Then the printer calculates the number of photo prints in the previous day as an actual consumption value from a difference in remaining amount of paper between the day and the previous day. The printer stores the actual consumption values in the form of a calendar cumulatively and creates a consumption record of the recording paper. Next, the printer estimates predicted consumption of the recording paper in a coming week based on the consumption record. And the printer predicts the time of occurrence of a paper-out condition based on the remaining amount of the recording paper and the predicted consumption. When it is predicted that the printer will be out of paper within a coming week, the printer displays a warning message on a LCD and urges a supervisor of the printer to prepare a new recording paper roll.

6 Claims, 7 Drawing Sheets

FIG.3A

PREVIOUS NOVEMBER

| WEEK | SUN | MON | TUE | WED | THU | FRI | SAT |
|---|---|---|---|---|---|---|---|
| DATE | | | | | | 1 | 2 |
| ACTUAL CONSUMPTION (UNIT: SHEET) | | | | | | 1200 | 1500 |
| DATE | 3 | 4 | 5 | 6 | 7 | 8 | 9 |
| ACTUAL CONSUMPTION (UNIT: SHEET) | 1500 | 500 | 300 | 300 | 600 | 1400 | 1400 |
| DATE | 10 | 11 | 12 | 13 | 14 | 15 | 16 |
| ACTUAL CONSUMPTION (UNIT: SHEET) | 1500 | 600 | 200 | 300 | 600 | 1200 | 1700 |
| DATE | 17 | 18 | 19 | 20 | 21 | 22 | 23 |
| ACTUAL CONSUMPTION (UNIT: SHEET) | 1600 | 600 | 300 | 400 | 700 | 1400 | 1500 |
| DATE | 24 | 25 | 26 | 27 | 28 | 29 | 30 |
| ACTUAL CONSUMPTION (UNIT: SHEET) | 1600 | 500 | 300 | 400 | 500 | 1300 | 1600 |

FIG.3B

THIS NOVEMBER

| WEEK | SUN | MON | TUE | WED | THU | FRI | SAT |
|---|---|---|---|---|---|---|---|
| DATE | | | | | | | 1 |
| ACTUAL CONSUMPTION (UNIT: SHEET) | | | | | | | 1700 |
| DATE | 2 | 3 | 4 | 5 | 6 | 7 | 8 |
| ACTUAL CONSUMPTION (UNIT: SHEET) | 1700 | 500 | 400 | 400 | 700 | 1500 | 1600 |
| DATE | 9 | 10 | 11 | 12 | 13 | 14 | 15 |
| ACTUAL CONSUMPTION (UNIT: SHEET) | | | | | | | |
| DATE | 16 | 17 | 18 | 19 | 20 | 21 | 22 |
| ACTUAL CONSUMPTION (UNIT: SHEET) | | | | | | | |
| DATE | 23 | 24 | 25 | 26 | 27 | 28 | 29 |
| ACTUAL CONSUMPTION (UNIT: SHEET) | | | | | | | |
| DATE | 30 | | | | | | |
| ACTUAL CONSUMPTION (UNIT: SHEET) | | | | | | | |

SEQUENCE OF CORRECTING PREDICTED CONSUMPTION BASED ON DIFFERENCE BETWEEN PREDICTED AND ACTUAL ONES

PRINTER

FIELD OF THE INVENTION

The present invention relates to a printer that controls consumable items expended according to the quantity of print.

BACKGROUND ART

There is a storefront type printer that is installed in a shop, to make it possible to print out images stored in digital cameras, camera phones, memory cards and the like at the store front. A supervisor of such a printer needs to check the remaining amount of print paper at regular intervals and when necessary, to supply paper not to run out of.

Since the procedure is bothersome, however, a device that monitors the remaining amount of paper and warns of a lack of paper when the remaining gets under a specific quantity is known for example from Japanese Laid-open Patent Application No. 2000-267520. The device is also possible to predetermine several patterns of the specific quantity and program respectively different predetermined amounts for either peak hours or bottom hours of paper consumption. This system allows warning of a lack of paper at an appropriate time according to the amount of paper consumption.

However, in a case of the foregoing device, a supervisor of the device needs to take extra effort to program the specific amount in advance in order to be encouraged to supply paper at a proper time. Moreover, where the consumption of paper changes from various kinds of factors including the location of shops, a day of the week and sale days, and a combination of these factors, like in the aforementioned storefront type printer, it is very burdensome and unpractical to program the necessary amounts one by one based on these diverse conditions.

SUMMARY OF THE INVENTION

In view of the foregoing problems, an object of the present invention is to provide a printer that solves the problems and makes it easy to control consumable items.

A printer of the present invention, loaded with a consumable product that is consumed according to the volume of prints made in the printer, comprises a remaining amount measurement device for measuring a remaining amount of the consumable product; an actual consumption recording device for memorizing a record of actual consumption of the consumable product; a prediction device for predicting based on the record of actual consumption how much the consumable product will be consumed from now on, and for predicting a run-out time when the printer will run out of the consumable product based on a predicted consumption value and a remaining amount of the consumable product detected at a time of prediction; and an alarming device for giving an alarm when the prediction device predicts that the printer will run out of the consumable product within a given period.

According to a preferred embodiment, the printer further comprises a device of detecting an actual consumption value on each day based on a difference in remaining amount of the consumable product between a day and a previous day, wherein the actual consumption recording device memorizes the actual consumption value on each day in association with a calendar, and the prediction device predicts a consumption value for a target day based on an actual consumption value on a same day of a same week of a same month a year ago.

It is preferable that the actual consumption recording device may be set up with data of those factors which have influence on consumption of the consumable product, e.g. data of sale days, and the prediction device corrects predicted consumption values based on the data.

According to a preferred embodiment, when an actual consumption value for a time period differs from a predicted consumption value for the time period, the prediction device corrects consumption values predicted for a coming time period based on a difference between the actual consumption value and the predicted consumption value, to re-predict the run-out time of the consumable product.

The remaining amount measuring device preferably measures the remaining amount of the consumable product at predetermined intervals to detect a consumption value at each interval, so that the prediction device re-predicts the run-out time of the consumable product when the detected consumption value is more than a predicted consumption value for the time of detection.

BRIEF DESCRIPTION OF THE DRAWINGS

FIGS. 3A and 3B are explanatory diagrams illustrating a consumption record stored in the form of a calendar;

DETAILED DESCRIPTION OF THE PREFERRED EMBODIMENTS

Figure 1:
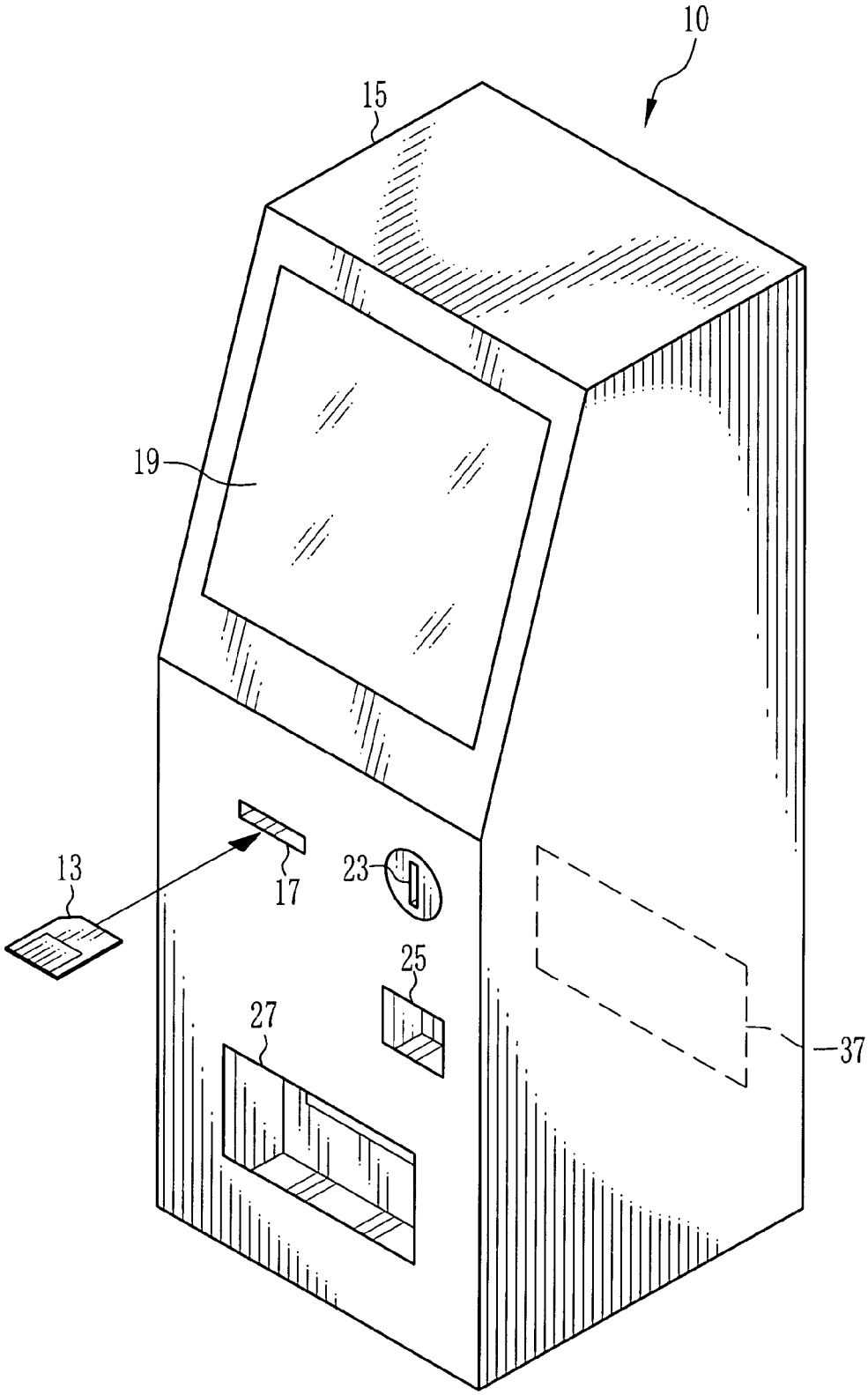
FIG. 1 is a perspective view of a printer according to an embodiment of the present invention.

FIG. 1 is an external view of a storefront type printer. A printer 10 is a device that prints out images photographed by digital cameras and the like and stored in a memory card 13 at the storefront and is installed in various places such as storefronts of photo shops and electrical appliance stores. It is possible for a user to print out the images stored in the memory card 13 by slotting the memory card 13 and putting the cost of printing into the printer 10.

On the front of a printer case 15, there is a memory card slot 17 into which a memory card 13 is inserted. In the inner part of the memory card slot 17, there is a memory card reader 18 (see FIG. 2) that reads images stored in the memory card 13.

Above a memory card slot 17, a liquid crystal display (LCD) 19 with a touch panel is disposed. The LCD 19 shows an operation screen including images read from the memory card 13, operation guidance and an after-mentioned warning message. A user selects their images to print and orders printing by touching the operation screen.

Figure 2:
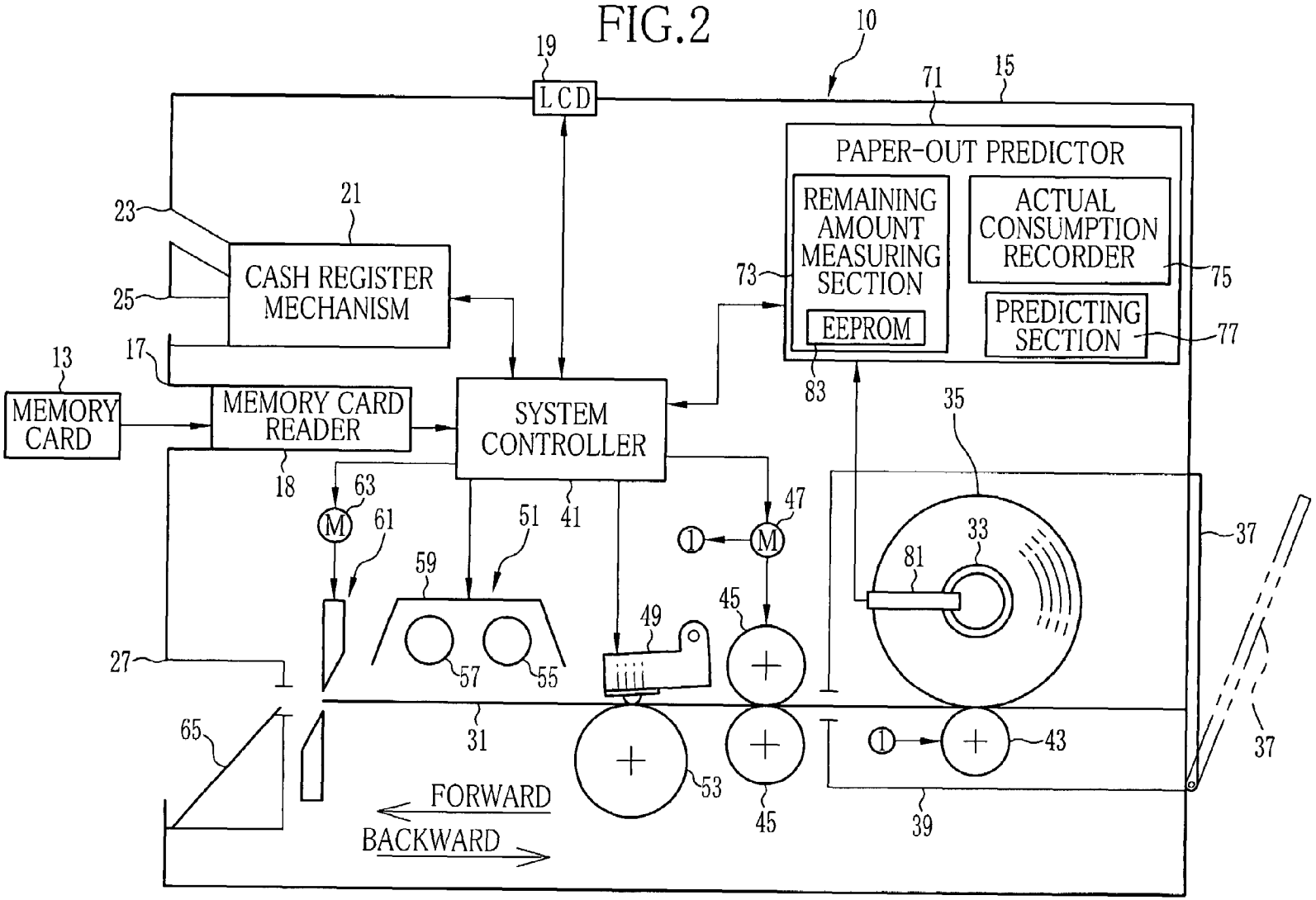
FIG. 2 is a schematic diagram illustrating the interior of the printer.

In addition, on the front of the printer case 15, there are also a coin slot 23 and a change slot 25 that are components of a cash register mechanism 21 (see FIG. 2.). After dropping coins into the coin slot 23, the mechanism subtracts the charge for printing from the total amount of paid money and paybacks the remaining money from the change slot 25. The series of processes settle the charge for printing and allow a printer to print images selected on the operation screen.

As FIG. 2 shows, the printer 10 uses a long web of color heat sensitive recording paper 31, hereinafter referred to as just recording paper, as a recording medium. On a base material of the recording paper 31, a cyan heat sensitive coloring layer, a magenta heat sensitive coloring layer, and a yellow heat sensitive coloring layer are formed atop another as known in the art. The top layer, the yellow heat sensitive coloring layer, has the highest heat sensitivity and develops yellow by a small amount of heat energy. The bottom layer, the cyan heat sensitive coloring layer, has the lowest heat sensitivity and develops cyan by a large amount of heat energy.

Moreover, the yellow heat sensitive coloring layer loses its ability of coloring when it is exposed to a yellow fixing light, a violet light whose wavelength is about 420 nm. The magenta heat sensitive coloring layer turns magenta by a medium amount of heat energy between the yellow heat sensitive coloring layer and the cyan one and loses its ability of coloring when it is exposed to a magenta fixing light, a near-ultraviolet light whose wavelength is about 365 nm. The recording paper 31 is used in the form of a recording paper roll 35 which is rolled around a spool 33. The printer case 15 has a paper chamber 39 which opens and closes with a lid 37 and in which the recording paper roll 35 is installed.

A system controller 41 that has control over every part of the printer 10 is built-in the printer 10. The system controller 41 controls driving of connected every part based on control signals inputted and sent from the LCD 19 and records images read from the memory card 13 in recording paper 31.

A paper feed roller 43 touches an outer circumferential surface of the recording paper roll 35 and feeds paper by pulling the recording paper 31 onto a paper conveying path. A pair of conveyer rollers 45 nips the fed recording paper 31 and conveys it to forward and backward directions The paper feed roller 43 and the pair of conveyer rollers 45 are driven by a conveyer motor 47. The system controller 41 counts the number of revolutions of the conveyer motor 47 and controls the conveying amount of the recording paper 31.

While the recording paper 31 is being conveyed, thermal recording and optical fixing are effected on the recording paper 31 by a thermal head 49 and by an optical fixing device 51. The thermal head 49 records color images in yellow, magenta and cyan while being pressed onto the recording paper 31 to apply heat to respective heat sensitive coloring layers. There is a platen roller 53 placed opposite the thermal head 49, so the recording paper 31 receives heat for recording in the state of being sandwiched between the thermal head 49 and the platen roller 53.

The optical fixing device 51 consists of a fixing lamp for yellow 55, a fixing lamp for magenta 57 and a reflector 59. The fixing lamp for yellow 55 performs optical fixing by applying a yellow fixing light to the yellow heat sensitive coloring layer which already has a yellow image recorded. The fixing lamp for magenta 57 performs optical fixing by applying a magenta fixing light to a magenta heat sensitive coloring layer which already has a magenta image recorded. The reflector 59 reflects the respective light from the fixing lamp for yellow 55 and from the fixing lamp for magenta 57 toward the recording paper 31. A cutter mechanism is driven by a cutter motor 63 and cuts a part finished with heat recording and optical fixing from recording paper 31. A cut sheet of paper is dropped through an output slot 27 (see FIG. 1).

Thus, every time an image is recorded, the recording paper 31 is consumed and the remaining amount of the paper runs down. A supervisor of the printer 10 refills a recording paper roll when the remaining amount of the paper gets zero. However, in case of no spare recording paper roll, a print service has to be stopped until a new roll is prepared. In order to prevent such a problem, the printer 10 has a paper-out predictor 71. The paper-out predictor 71 consists of a remaining amount measuring section 73, an actual consumption recorder 75 and a predicting section 77, and predicts in advance the amount of paper consumed in a week and when it is predicted that the remaining amount of the paper will get zero within a week, it informs of that.

The remaining amount measuring section 73 is connected to a roll radius sensor 81. The roll radius sensor 81 detects a roll radius of the recording paper roll 35 at a predetermined time once a day, for example, at each opening time of a shop where the printer 10 is installed in this embodiment, and sends the data of the radius to the remaining amount measuring section 73. The remaining amount measuring section 73 measures the remaining amount of recording paper 31 in terms of the number of available photo prints based on the data of the roll radius of the recording paper 31. The remaining amount measuring section 73 has an EEPROM 83 where the measured remaining amount is stored. The EEPROM 83 stores the remaining amounts for last two days and updates the remaining amount whenever the remaining amount is measured once a day.

The actual consumption recorder 75 computes actual consumption, i.e. the number of photo prints made in the previous day, from the difference between the remaining amount in the day and the one in that previous day. And the actual consumption recorder 75 makes a consumption record of the recording paper 31 by storing the actual consumption values in the form of a calendar cumulatively. As shown for example in FIG. 3, the actual consumption recorder 75 stores calendar data of last two years and keeps the actual consumption of every day in relation to the date.

A predicting section 77 predicts the time of occurrence of a paper-out condition. In predicting the paper-out time, the predicting section 77 determines the anticipated amount of consumption in each day over a week based on the consumption record of the recording paper 31 as stored in the actual consumption recorder 75. When the predicted consumption in one day is designated as Pd, the predicting section 77 calculates the predicted consumption Pd from a basic equation:

Pd=base expectancy Vb×prediction coefficient C.

Figure 4:
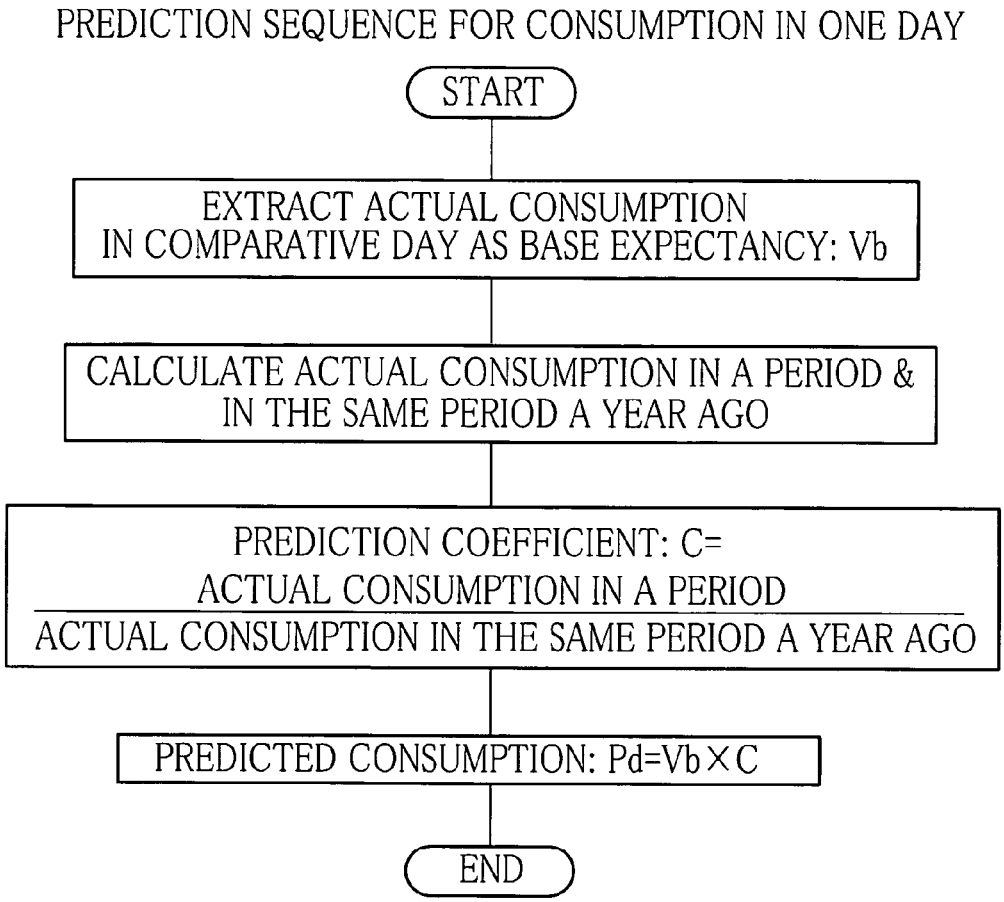
FIG. 4 is a flowchart illustrating a prediction sequence for consumption in one day.

FIG. 4 illustrates a computing sequence for predicted consumption Pd in one day.

Base expectancy Vb is a base value for prediction that is obtained by extracting actual consumption in a day for prediction, hereinafter referred to as a target day, and actual consumption in a comparative day, that is a day of the same week day in the same week in the same month a year ago. For example, in FIG. 3, when a target day is Sunday in the third week in this November, a comparative day is Sunday in the third week in last November, so the actual consumption on Sunday in the third week in the last November, which is stored in the actual consumption recorder 75, is used as the base expectancy Vb. In the example of FIG. 3, the base expectancy Vb becomes 1500.

Prediction coefficient C is a coefficient expressing a change of consumption between this year and last year and is determined for example as follows. First, actual consumption in previous six months from a prediction day, hereinafter referred to as actual consumption in a period, and actual consumption in the same period a year ago are detected by referring to the consumption record. Then the prediction coefficient C is gained by dividing the actual consumption in a period by the actual consumption in the same period a year ago.

And the predicting section 77 estimates the predicted consumption Pd in the target day by multiplying the base expectancy Vb by the prediction coefficient C. The predicting section 77 sequentially calculates a predicted consumption value Pd1 in a first day and then one Pd2 in the next day, one Pd3 in the day after the next and so on, to obtain predicted consumption values Pd1 to Pd8 for each day of a week.

Next, the paper-out predictor 71 subtracts predicted consumption Pd1 to Pd8 one after another from the remaining amount of the recording paper 31 and predicts the time of occurrence of a paper-out condition. For example, if the remaining amount gets minus by the subtraction of Pd1 and Pd2, the paper-out time is predicted to be the next day. If the remaining amount gets minus by the subtraction of Pd1, Pd2 and Pd3, the paper-out time is predicted to be the day after next. If the remaining amount doesn't get minus by the subtraction of Pd1 to Pd8, it is predicted that a paper-out condition won't occur within a week. The paper-out predictor 71 sends a warning signal to the system controller 41 when it predicts that a paper-out condition will occur within a week.

Figure 5:
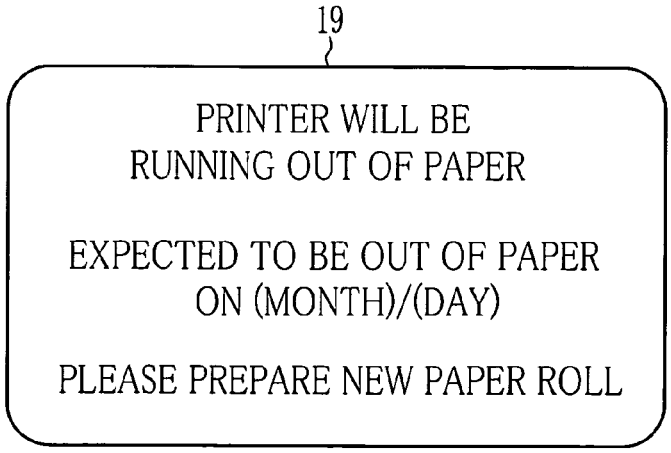
FIG. 5 is an explanatory diagram illustrating a warning message.

Upon receipt of the warning signal, the system controller 41 displays a warning message on the LCD 19, to give an alarm to the supervisor of the printer 10. As shown for example in FIG. 5, the warning message includes a notification that the printer 10 is being running out of paper, the date expected to be out of paper, and a recommendation urging to prepare a new recording paper roll.

Figure 6:
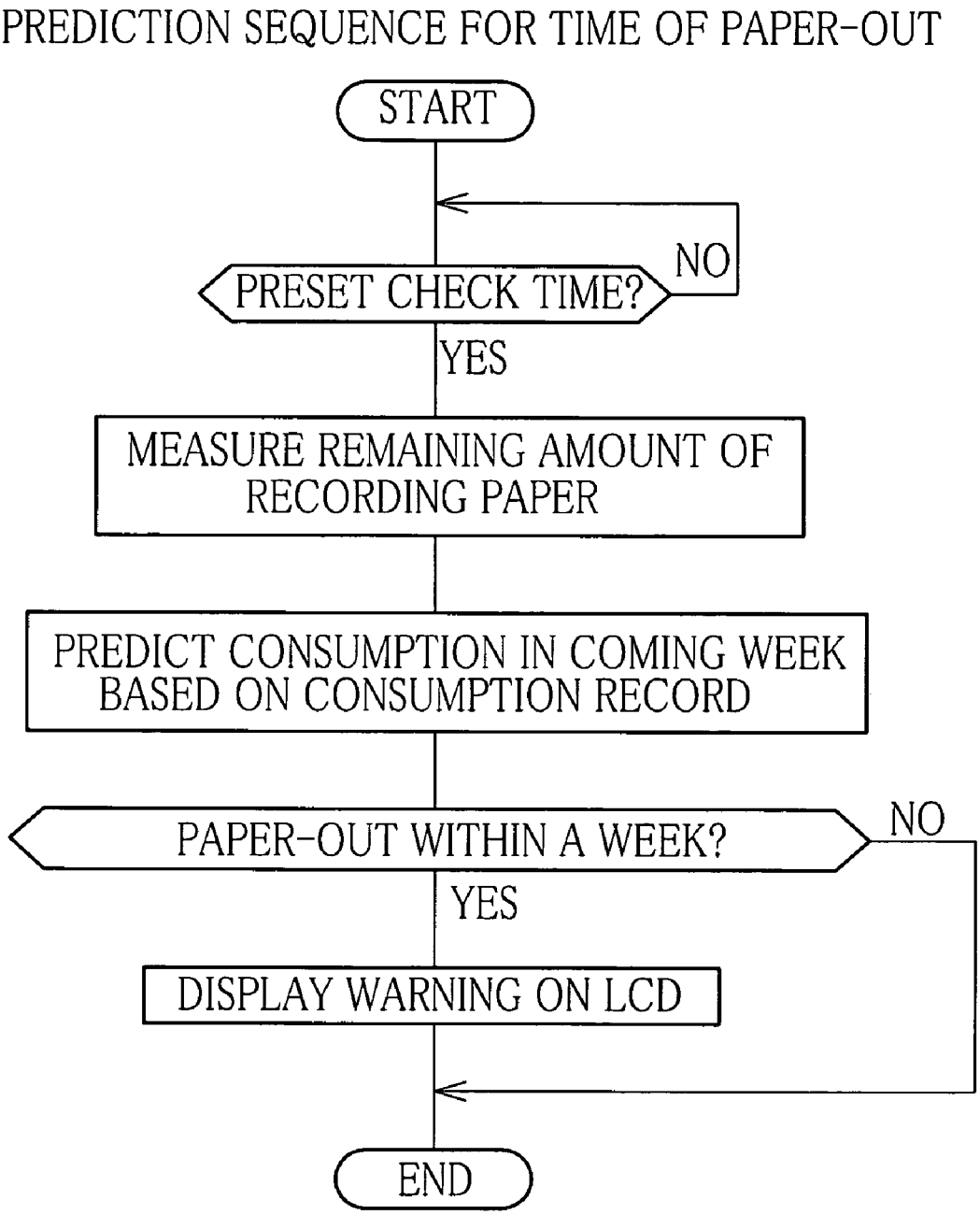
FIG. 6 is a flowchart illustrating a prediction sequence for time of paper-out.

Now the operation of the above described embodiment will be explained while referring to the flowchart in FIG. 6.

The printer 10 detects the roll radius of the recording paper roll 35 at opening time of the shop where the printer 10 is installed, to measure the remaining amount of recording paper 31 based on the detected radius of the roll 35. Then the printer 10 calculates the number of photo prints in the previous day (actual consumption in the day before) from the remaining amount of paper in the day and that in the day before. The printer 10 stores the actual consumption in the form of a calendar cumulatively. This procedure leads to make a consumption record of recording paper 31.

Next, after estimating predicted consumption of the recording paper 31 in a coming week Pd1 to Pd8 based on the consumption record, the printer 10 subtracts the predicted consumption Pd1 to Pd8 sequentially from the remaining amount of recording paper 31, to predict the paper-out time. When it is predicted that a paper-out condition will occur within a coming week, the printer 10 displays a warning message on the LCD 19 and urges a supervisor of the printer 10 to prepare a new recording paper roll 35. After recognizing the warning message the supervisor of the printer 10 starts to prepare the new recording paper roll 35.

Thus because the printer 10 predicts the paper-out time once a day and informs of it when a paper-out condition occurs in a few days, it is possible to prevent the printer 10 from being out of paper suddenly, and thus prevent a sudden stop of print service. Moreover, the prediction of the paper-out time based on the printer's consumption record guarantees a precise prediction while taking account of various factors including a day of the week, the location of the shop where the printer is installed and the respective printers' consumption trend. The precise prediction enables to send a warning at appropriate timing without the necessity of subtilizing the predetermined amount for warning.

Figure 7:
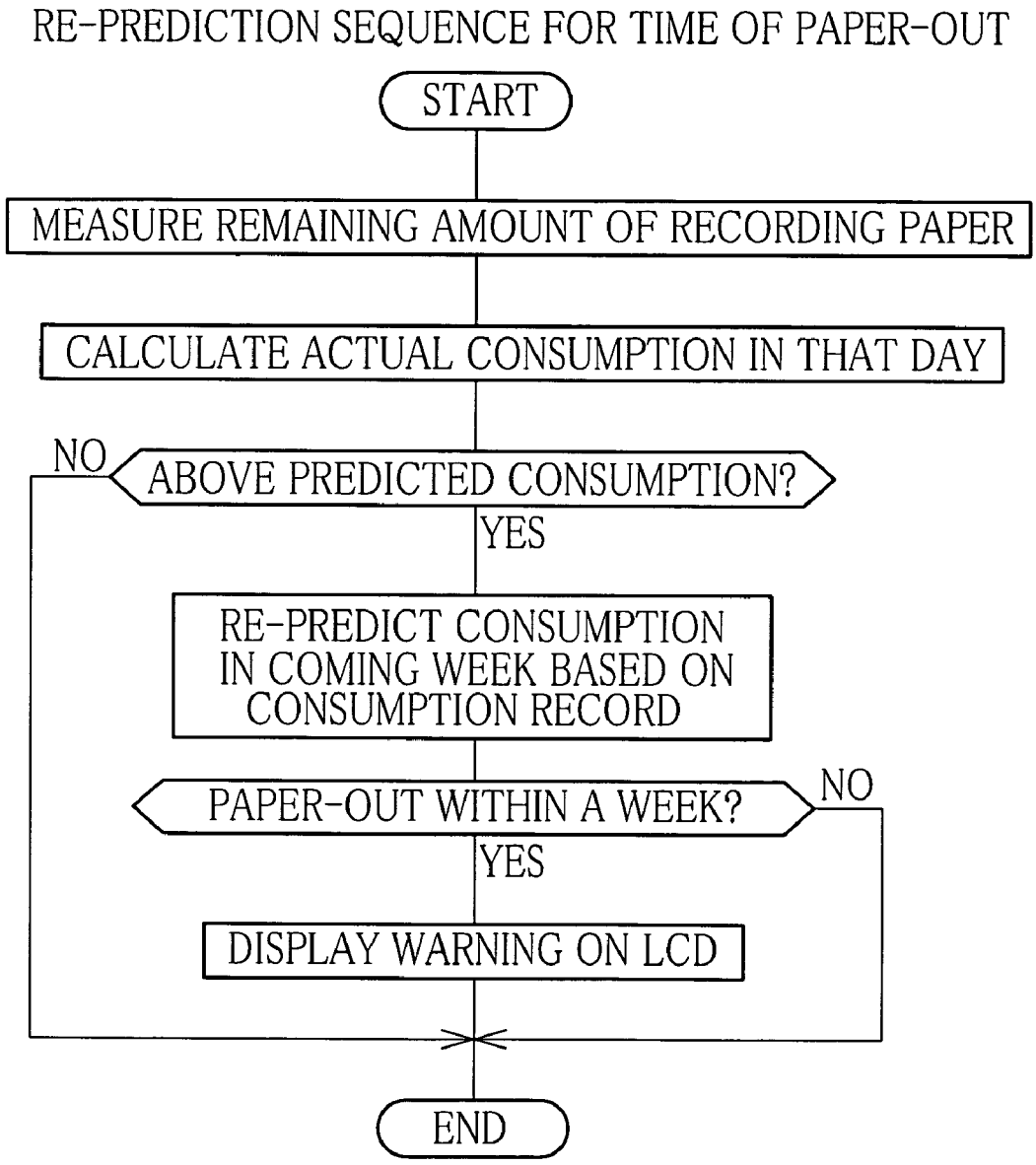
FIG. 7 is a flowchart illustrating a re-prediction sequence for time of paper-out.

In the above described embodiment, prediction of the paper-out time is carried out once a day. However, actual consumption can sometimes exceed during business hours the amount predicted to be used in the day at opening time. In order to cope with this problem, as FIG. 7 shows, it is possible to measure the remaining amount of recording paper continually, for example once an hour, since the shop opening time, and calculate actual consumption in the day from the measured remaining amount. In this embodiment, if the actual consumption gets above the predicted consumption, it is also possible to re-predict the paper-out time and inform of it if it is predicted that the printer will be running out of paper within a week. The re-prediction allows more precise prediction of the paper-out time.

Moreover, the timing of measuring the remaining amount of recording paper and predicting the paper-out time may be appropriately determined instead of the above described timing. In the above described embodiment, the printer predicts consumption in a coming week and displays a warning message if a paper-out condition is predicted within a week. But it is possible to freely determine the prediction period. For example, a printer may predict consumption in a coming month and display a warning message in case that a paper-out condition is predicted within this period.

Figure 8:
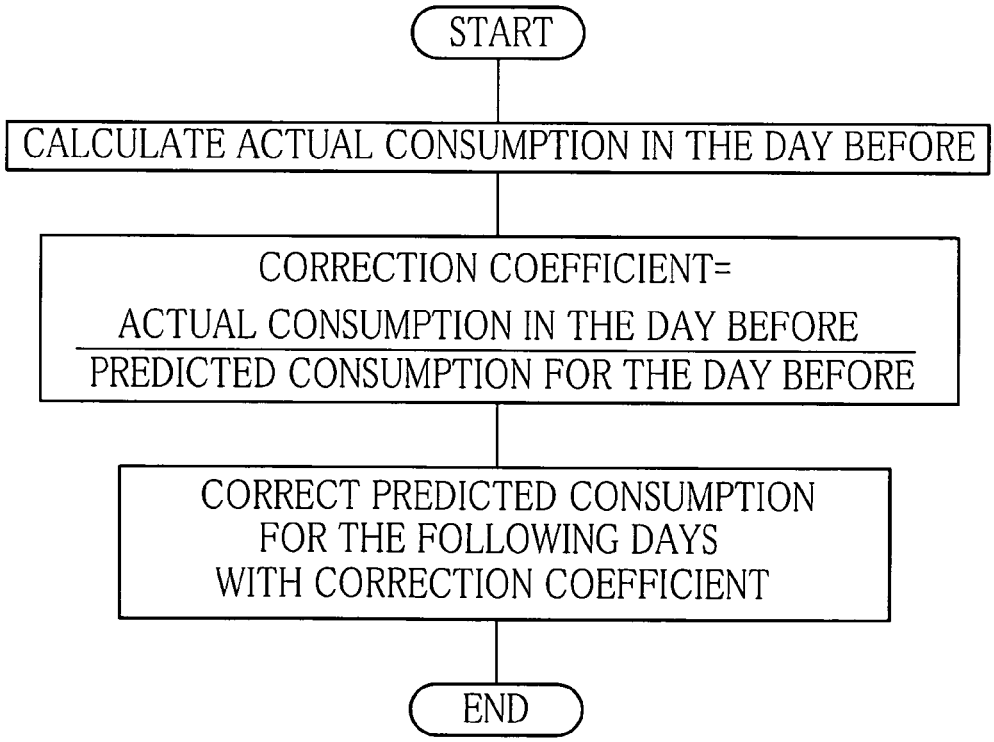
FIG. 8 is a flowchart illustrating a prediction sequence of correcting predicted consumption based on difference between predicted and actual ones.

It is also possible to correct predicted consumption when the calculated actual consumption in the previous day was different from the already predicted one for the same day. As a way of correcting predicted consumption, for example as FIG. 8 shows, it is possible to calculate a correction coefficient by dividing the actual consumption in the day before by the predicted consumption for the same day. Then, predicted consumption values for the following days are corrected by multiplying the predicted consumption values by the correction coefficient. Thereby, it becomes possible to predict consumption more precisely.

In the above described embodiment, actual consumption in the same week day of the same week of the same month a year ago is served as a base expectancy, to calculate predicted consumption by multiplying the base expectancy by a rate of change that represents a change of consumption trend from last year to this year. This calculation allows prediction considering various factors that have influence on consumption, such as the month, the week, the day of the week and secular consumption trend. But because there should be different factors affecting consumption other than the above factors, it is possible to make these factors reflect in the prediction. An example of those factors is a sale day of the shop where the printer is installed. Consumption on the sale day is probably higher than one on a normal business day and so when a target day for prediction will be a sale day, it is better to take it into consideration.

For this case, information about sale days should be able to be inputted into the consumption calendar. If a prediction day is a sale day, consumption predicted for that day is corrected by multiplying a predicted consumption value by a sale-day coefficient gained from a past consumption record using a given formula.

If information about sale days is stored in the calendar, it is possible discriminate whether the actual consumption record from which base expectancy is extracted is on a sale day or on a normal business day, and correct the predicted consumption accordingly. For example, when a prediction day is a normal business day and the comparative day was a sale day, it is better to correct actual consumption in the comparative day by dividing it by a sale-day coefficient and regard the gained consumption as base expectancy. With this correction, accuracy of prediction is more improved.

For the present invention, it is important to record actual consumption and predict consumption for the following days based on the consumption record. Within this basic concept of the present invention, the sequence and way of prediction aren't limited to the above described embodiment, but they may change appropriately. For example, in the above described embodiment, base expectancy is gained from actual consumption in the same month a year ago, but it is possible to determine the base expectancy based on actual consumption in the previous month or in the previous week. Other than the above described embodiment, there have been known several ways to predict consumption for the following days based on actual consumption in the past, and it is possible to employ any of those prior prediction methods.

In the above described embodiment, an alarm is given to a supervisor by displaying a warning message on a LCD in a printer. But as a way of alarm it is possible to send a warning message to a control terminal that controls the respective printers via communication lines. In this case, the printer is provided with a communication device and is connected to the control terminal through well-known electric communication lines such as phone lines or wireless LAN, to send a warning message from the printer to the control terminal via the communication lines. With this system, it is possible to grasp the respective remaining amounts of recording paper in a number of printers through a single control terminal.

In the above described embodiment, the remaining amount of recording paper is measured from a roll radius of a recording paper roll. But it is possible to detect the remaining amount of recording paper from the number of photo prints. In the above described embodiment, a printer uses the recording paper roll. But the present invention is applicable to a printer that uses cut sheets of recording paper precut in a specified size.

The above described embodiment uses a direct heat sensitive color thermal printer that performs thermal recording by applying heat from a thermal head to color heat sensitive recording paper. But the present invention is applicable to a thermal transfer type printer that transfers ink to paper by heating ink ribbons or ink sheets with a thermal head. Moreover, the present invention is applicable to other type of printers such as an ink jet printer or a laser printer instead of thermal printers.

In the above described embodiment, an example of consumable items is recording paper. But it is possible to apply the present invention to predict consumption of other consumables such as ink ribbons or jet ink instead of recording paper. Moreover, it is also possible to predict the time of running out of two or more kinds of consumables like recording paper and ink.

Thus, the present invention is not to be limited to the above described embodiments but, on the contrary, various modifications will be possible without departing from the scope and spirit of the invention as specified in claims appended hereto.

What is claimed is:

1. A printer having a consumable product loaded therein, said consumable product being consumed according to the volume of prints made in said printer, said printer comprising:

a remaining amount measurement device for measuring a remaining amount of said consumable product;

an actual consumption recording device for memorizing a record of actual consumption of said consumable product;

a prediction device for predicting based on said record of actual consumption how much said consumable product will be consumed from now on, and for predicting a run-out time when said printer will run out of said consumable product based on a predicted consumption value and a remaining amount of said consumable product detected at a time of prediction;

an alarming device for giving an alarm when said prediction device predicts that said printer will run out of said consumable product within a given period, and a device of detecting an actual consumption value on each day based on a difference in remaining amount of said consumable product between a day and a previous day.

2. A printer as claimed in claim 1, wherein said actual consumption recording device memorizes the actual consumption value on each day in association with a calendar, and said prediction device predicts a consumption value for a target day based on an actual consumption value on a same day of a same week of a same month a year ago.

3. A printer as claimed in claim 1, wherein said actual consumption recording device may be set up with data of those factors which have influence on consumption of said consumable product, and said prediction device corrects predicted consumption values based on said data.

4. A printer as claimed in claim 3, wherein said data include data of sale days.

5. A printer as claimed in claim 1, wherein when an actual consumption value for a time period differs from a predicted consumption value for said time period, said prediction device corrects consumption values predicted for a coming time period based on a difference between said actual consumption value and said predicted consumption value, to re-predict the run-out time of said consumable product.

6. A printer as claimed in claim 5, wherein said remaining amount measuring device measures the remaining amount of said consumable product at predetermined intervals to detect a consumption value at each interval, and when said detected consumption value is more than a predicted consumption value for the time of detection, said prediction device re-predicts the run-out time of said consumable product.

* * * * *